US010821618B1

(12) United States Patent
Morrison

(10) Patent No.: US 10,821,618 B1
(45) Date of Patent: Nov. 3, 2020

(54) FOAM DISPENSING ELECTRIC SHAVER APPARATUS

(71) Applicant: Tonisha Morrison, Athens, GA (US)

(72) Inventor: Tonisha Morrison, Athens, GA (US)

( * ) Notice: Subject to any disclaimer, the term of this patent is extended or adjusted under 35 U.S.C. 154(b) by 0 days.

(21) Appl. No.: 16/446,075

(22) Filed: Jun. 19, 2019

(51) Int. Cl.

| | |
|---|---|
| ***B26B 19/40*** | (2006.01) |
| ***B26B 19/14*** | (2006.01) |
| ***B26B 19/38*** | (2006.01) |
| ***A45D 34/06*** | (2006.01) |
| *A45D 34/00* | (2006.01) |

(52) U.S. Cl.
CPC ..... *B26B 19/40* (2013.01); *A45D 34/06* (2013.01); *B26B 19/146* (2013.01); *B26B 19/3853* (2013.01); *B26B 19/3873* (2013.01); *B26B 19/3886* (2013.01); *A45D 2034/005* (2013.01)

(58) Field of Classification Search
CPC .... B26B 19/40; B26B 19/146; B26B 19/3853
See application file for complete search history.

(56) References Cited

U.S. PATENT DOCUMENTS

| | | | | |
|---|---|---|---|---|
| 3,252,217 | A | 5/1966 | Werft | |
| 5,092,041 | A | 3/1992 | Podolsky | |
| 5,121,541 | A | 6/1992 | Patrakis | |
| D412,599 | S | 8/1999 | De Visser | |
| 6,312,436 | B1 | 11/2001 | Rijken | |
| RE38,634 | E * | 10/2004 | Westerhof | A61C 17/227 30/41 |
| 8,028,708 | B2 | 10/2011 | Molema | |
| 2003/0101589 | A1 | 6/2003 | Barish | |
| 2006/0150420 | A1* | 7/2006 | Sinnema | B26B 19/04 30/43.6 |
| 2012/0005898 | A1* | 1/2012 | Molema | B26B 19/40 30/41 |
| 2015/0314463 | A1 | 11/2015 | Mgbeahurike | |

* cited by examiner

*Primary Examiner* — Stephen Choi

(57) ABSTRACT

A foam dispensing electric shaver apparatus for conveniently dispensing shaving foam includes a handle body having an insert cavity with a feed aperture extending through to an inner compartment. A foam insert is electively engageable within the insert cavity. A shaver is coupled to the handle body and comprises a neck coupled to a neck aperture, a head coupled to the neck, and a set of blades coupled to the head. A motor is coupled within the inner compartment and is powered by a rechargeable battery to drive the set of blades. A foam dispenser has a pump adjacent the insert cavity and a spout extending through the front side of the handle body. A dispense button coupled to the handle body activates the pump to draw foam from the foam insert and release it through a distal end of the spout.

8 Claims, 4 Drawing Sheets

FOAM DISPENSING ELECTRIC SHAVER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shavers and more particularly pertains to a new shaver for conveniently dispensing shaving foam.

BRIEF SUMMARY OF THE INVENTION

An embodiment of the disclosure meets the needs presented above by generally comprising a handle body having a front side, a back side, a left side, a right side, a top side, and a bottom side forming an inner compartment. The back side has an insert cavity extending towards the inner compartment. A top wall of the insert cavity has a feed aperture extending through to the inner compartment. The front side has a neck aperture extending through to the inner compartment adjacent the top side. A foam insert is electively engageable within the insert cavity. The foam insert has a foam canister and a release nipple coupled to the foam canister. The release nipple is insertable within the feed aperture. An insert cover is coupled to the handle body and is selectively engageable with the insert cavity to cover and alternatively expose the insert cavity. A shaver is coupled to the handle body and comprises a neck coupled to the neck aperture, a head coupled to the neck, and a set of blades coupled to the head. The head has a bottom face coupled to the neck and a top face. The set of blades comprises three rotary blades each coupled to the top face of the head. A motor is coupled to the handle body within the inner compartment proximal the top side. The motor has a motor shaft extending through the neck to the head of the shaver. The motor shaft is in operational communication with the set of blades. A foam dispenser is coupled to the handle body. The foam dispenser has a pump coupled within the inner compartment adjacent the insert cavity and a spout coupled to the pump and extending through the front side of the handle body. The pump is in operational communication with the feed aperture to draw foam from the foam insert and release it through a distal end of the spout. A dispense button is coupled to the handle body and is in operational communication with the pump. A power button is coupled to the handle body and is in operational communication with the motor. A rechargeable battery is coupled to the handle body within the inner compartment adjacent the bottom side and is in operational communication with the dispense button and the power button. A charge port is coupled to the handle body and extends through the bottom side. The charge port is in operational communication with the rechargeable battery and is configured to receive a charging cable.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
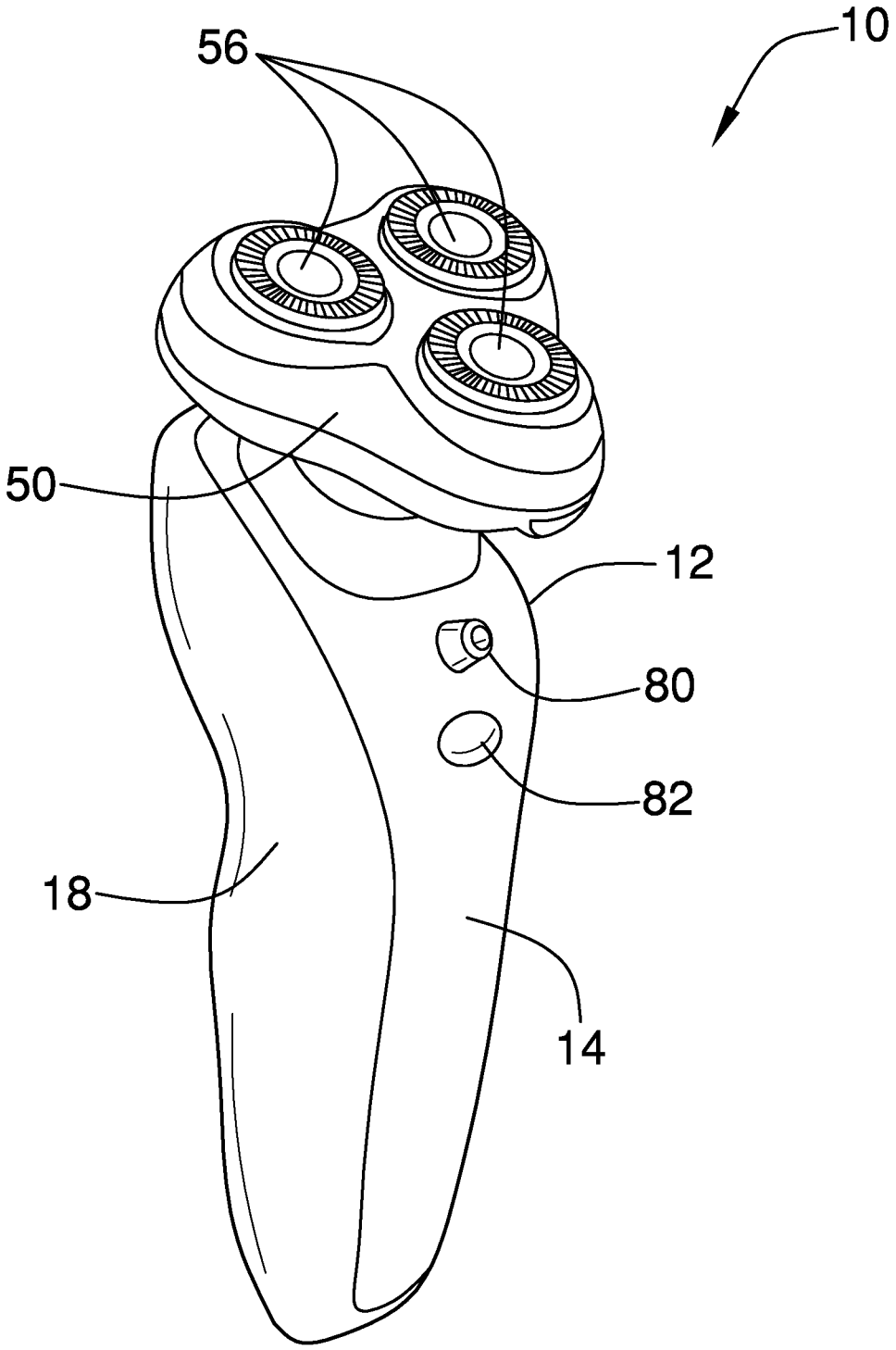
FIG. 1 is an isometric view of a foam dispensing electric shaver apparatus according to an embodiment of the disclosure.
Figure 2:
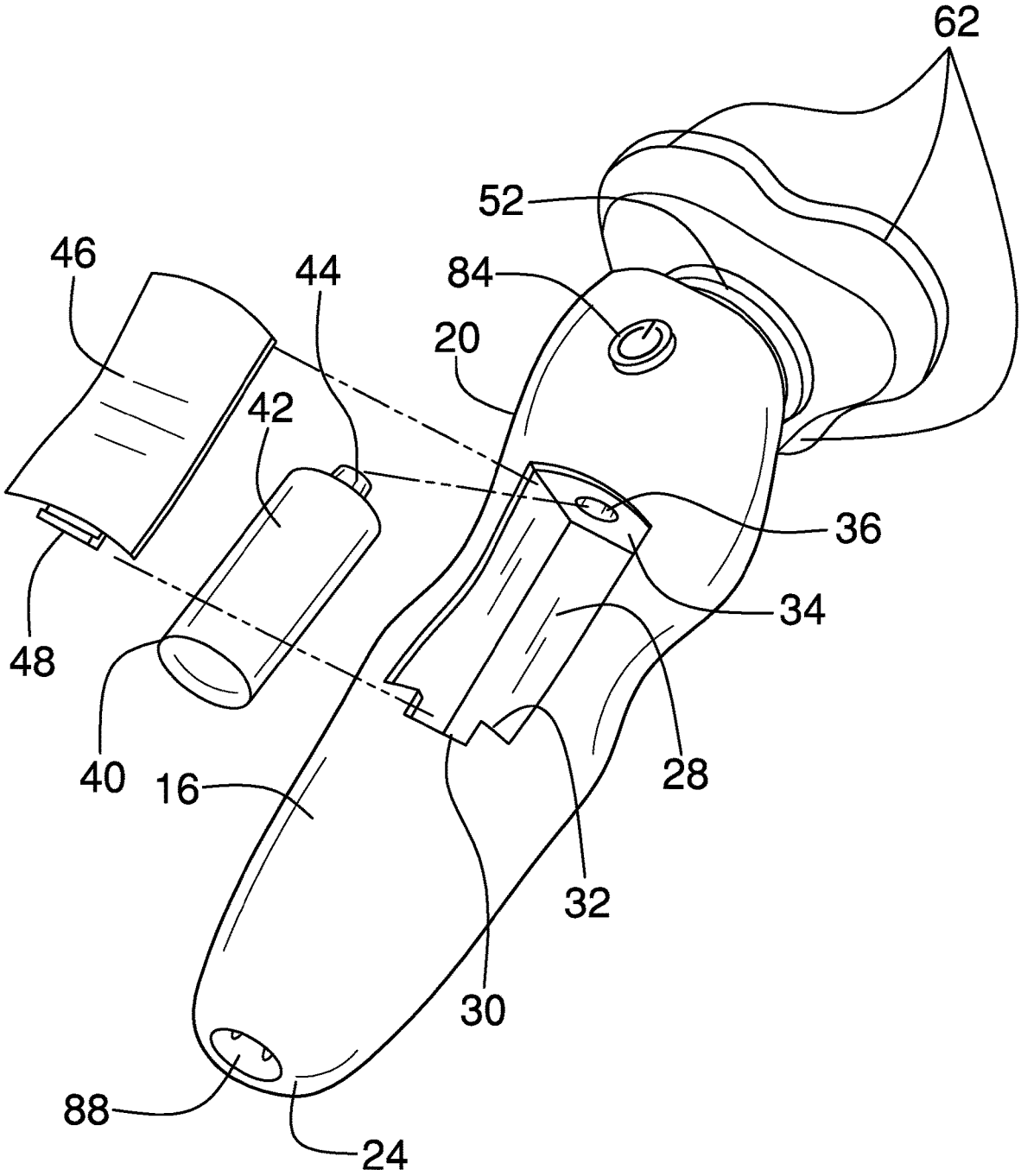
FIG. 2 is an isometric view of an embodiment of the disclosure.
Figure 3:
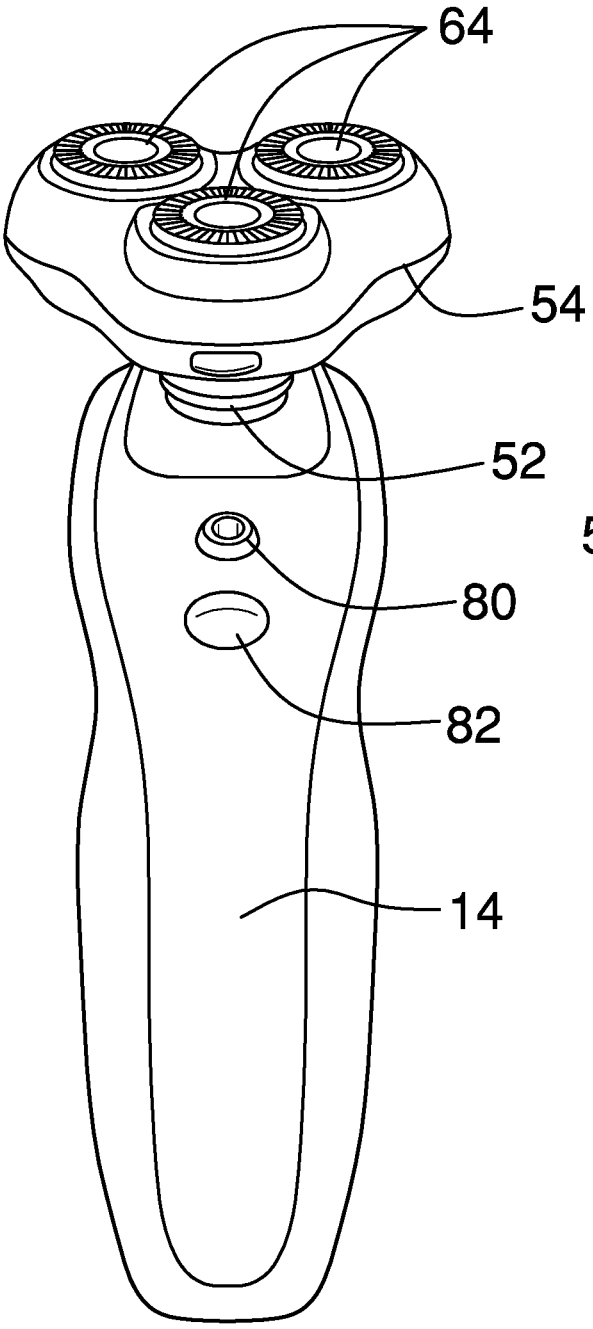
FIG. 3 is a front elevation view of an embodiment of the disclosure.
Figure 4:
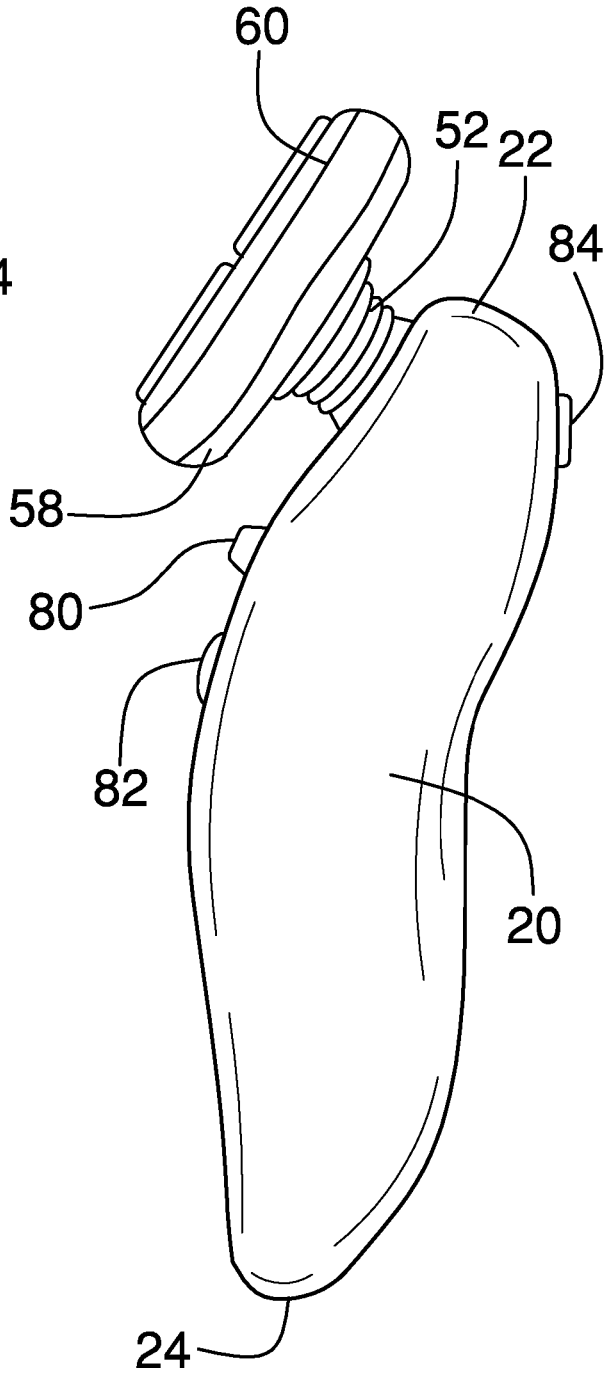
FIG. 4 is a side elevation view of an embodiment of the disclosure.
Figure 5:
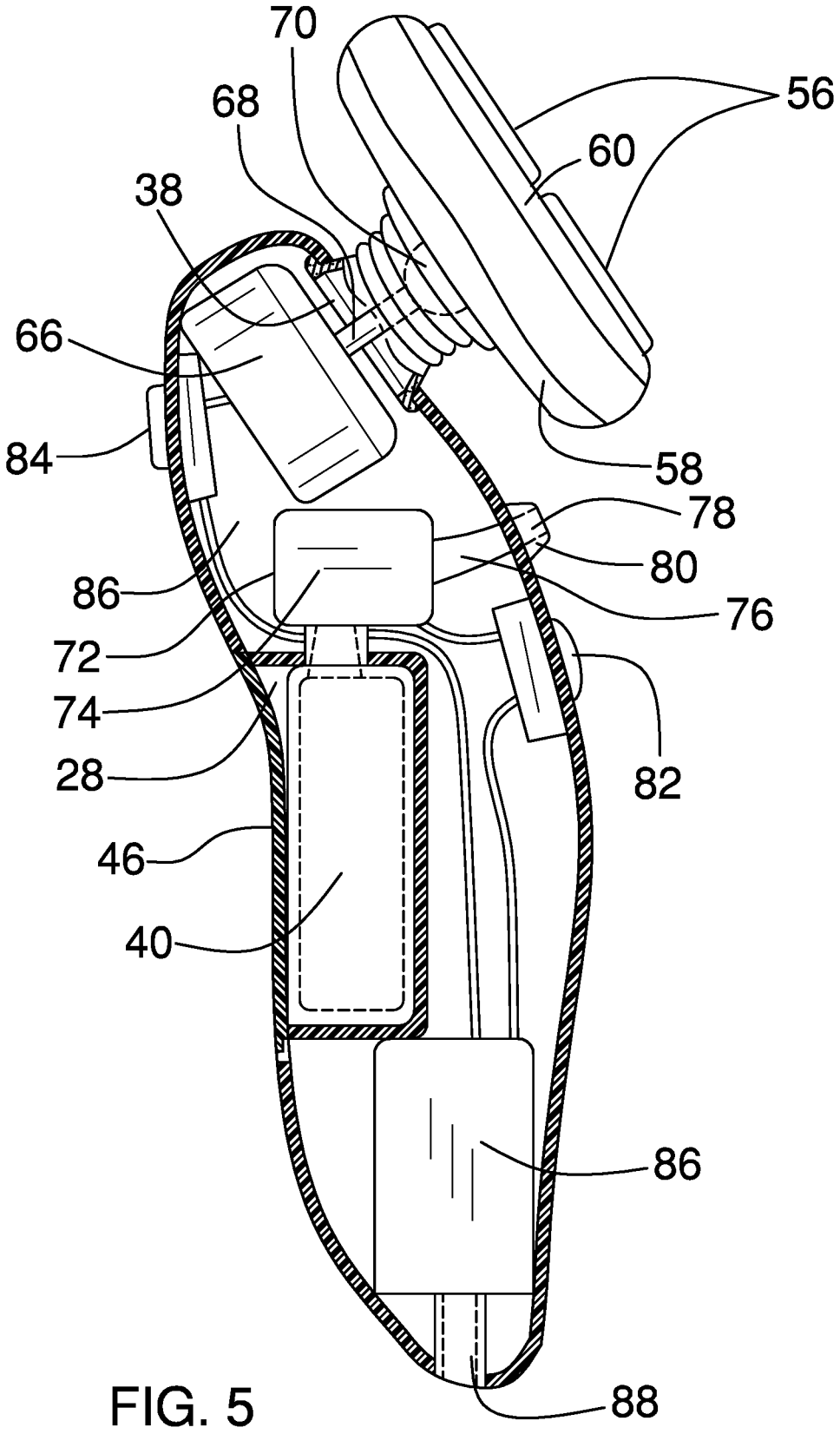
FIG. 5 is a cross-sectional view of an embodiment of the disclosure.

With reference now to the drawings, and in particular to FIGS. 1 through 5 thereof, a new shaver embodying the principles and concepts of an embodiment of the disclosure and generally designated by the reference numeral 10 will be described.

As best illustrated in FIGS. 1 through 5, the foam dispensing electric shaver apparatus 10 generally comprises a handle body 12 having a front side 14, a back side 16, a left side 18, a right side 20, a top side 22, and a bottom side 24 forming an inner compartment 26. The front side 14 and the back side 16 are curved and taper towards the bottom side 24, which is rounded, to create an ergonomic shape for the handle body 12. The back side 16 has an insert cavity 28 extending towards the inner compartment 26. The insert cavity 28 may be rectangular with a notch 30 extending from a bottom wall 32. A top wall 34 of the insert cavity has a feed aperture 36 extending through to the inner compartment 26. The front side 14 has a neck aperture 38 extending through to the inner compartment 26 adjacent the top side 22. A foam insert 40 is selectively engageable within the insert cavity 28. The foam insert 40 has a cylindrical foam canister 42 and a release nipple 44 coupled to the foam canister 42 to release shaving foam. The release nipple 44 is insertable within the feed aperture 36. An insert cover 46 is selectively engageable with the insert cavity 28 to cover and alternatively expose the insert cavity 28. The insert cover 46 has an L-shaped latch 48 to engage the notch 30.

A shaver 50 is coupled to the handle body 12 and comprises a neck 52 coupled to the neck aperture 38, a head 54 coupled to the neck 52, and a set of blades 56 coupled to the head 54. The neck 52 is corrugated and flexible to allow the head 54 to pivot. The head 54 has a bottom face 58 coupled to the neck 52 and a top face 60. The head 54 comprises a set of three rounded portions 62 in a triangular arrangement. The set of blades 56 comprises three rotary blades 64 each coupled to the top face 60 of the head with each blade 64 accommodated by a rounded portion of the set of rounded portions 62. A motor 66 is coupled within the inner compartment 26 proximal the top side 22. The motor 66 has a motor shaft 68 extending through the neck 52 to the head 54 of the shaver and is in operational communication with the set of blades 64. The motor shaft 68 has a rounded ball joint 70 coupled to the head 54 to allow the head 54 to pivot.

A foam dispenser 72 is coupled to the handle body 12. The foam dispenser 72 has a pump 74 coupled within the inner compartment 26 adjacent the insert cavity 28 and a spout 76 coupled to the pump 74 and extending through the front side 14 of the handle body. The pump 74 is in operational communication with the feed aperture 36 to draw foam from the foam insert 40 and release it through a distal end 78 of the spout. The spout 76 has a truncated conical tip 80 coupled to the front side 14 of the handle body. A dispense button 82 is coupled to the front side 14 of the handle body below the tip 80 of the spout. The dispense button 82 is in operational communication with the pump 74 to trigger foam release.

A power button 84 is coupled to the back side 16 proximal the top side 22 and is in operational communication with the motor 66. A rechargeable battery 86 is coupled to the handle body 12 within the inner compartment 26 adjacent the bottom side 24. The rechargeable battery 86 is in operational communication with the dispense button 82 and the power button 84. A charge port 88 is coupled to the handle body 12 and extends through the bottom side 24. The charge port 88 is in operational communication with the rechargeable battery 86 and is configured to receive a charging cable.

In use, the foam insert 40 is loaded into the insert cavity 28 and the insert cover 46 is engaged with the handle body 12. The shaver 50 is then operated with the power button 84 and is used like a traditional shaver, while the dispense button 82 is used to conveniently deliver shaving foam from the foam insert 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A foam dispensing electric shaver apparatus comprising:

a handle body, the handle body having a front side, a back side, a left side, a right side, a top side, and a bottom side forming an inner compartment, the back side having an insert cavity extending towards the inner compartment, a top wall of the insert cavity having a feed aperture extending through to the inner compartment; the front side having a neck aperture extending through to the inner compartment adjacent the top side;

a foam insert, the foam insert being selectively engageable within the insert cavity, the foam insert having a foam canister and a release nipple coupled to the foam canister, the release nipple being insertable within the feed aperture;

an insert cover coupled to the handle body, the insert cover being selectively engageable with the insert cavity to cover and alternatively expose the insert cavity;

a shaver coupled to the handle body, the shaver comprising:

a neck coupled to the neck aperture;

a head coupled to the neck, the head having a bottom face coupled to the neck and a top face; and a set of blades coupled to the head, the set of blades comprising three rotary blades each coupled to the top face of the head;

a motor coupled to the handle body, the motor being coupled within the inner compartment proximal the top side, the motor having a motor shaft extending through the neck to the head of the shaver, the motor shaft being in operational communication with the set of blades;

a foam dispenser coupled to the handle body, the foam dispenser having a pump coupled within the inner compartment adjacent the insert cavity and a spout coupled to the pump and extending through the front side of the handle body, the pump being in operational communication with the feed aperture to draw foam from the foam insert and release it through a distal end of the spout;

a dispense button coupled to the handle body, the dispense button being in operational communication with the pump;

a power button coupled to the handle body, the power button being in operational communication with the motor;

a rechargeable battery coupled to the handle body, the rechargeable battery being coupled within the inner compartment adjacent the bottom side, the rechargeable battery being in operational communication with the dispense button and the power button; and a charge port coupled to the handle body, the charge port extending through the bottom side and being in operational communication with the rechargeable battery, the charge port being configured to receive a charging cable.

2. The foam dispensing electric shaver apparatus of claim 1 further comprising the neck being corrugated and flexible, the motor shaft having a rounded ball joint coupled to the head of the shaver to allow the head to pivot.

3. The foam dispensing electric shaver apparatus of claim 1 further comprising the foam canister being cylindrical.

4. The foam dispensing electric shaver apparatus of claim 1 further comprising the head being comprising a set of three rounded portions in a triangular arrangement, the rounded portions accommodating the set of blades.

5. The foam dispensing electric shaver apparatus of claim 1 further comprising the spout having a truncated conical tip coupled to the front side of the handle body.

6. The foam dispensing electric shaver apparatus of claim 5 further comprising the dispense button being coupled to the front side of the handle body below the tip of the spout.

7. The foam dispensing electric shaver apparatus of claim 1 further comprising the power button being coupled to the back side proximal the top side.

8. A foam dispensing electric shaver apparatus comprising:

a handle body, the handle body having a front side, a back side, a left side, a right side, a top side, and a bottom side forming an inner compartment, the back side having an insert cavity extending towards the inner compartment, a top wall of the insert cavity having a feed aperture extending through to the inner compartment; the front side having a neck aperture extending through to the inner compartment adjacent the top side;

a foam insert, the foam insert being selectively engageable within the insert cavity, the foam insert having a cylindrical foam canister and a release nipple coupled to the foam canister, the release nipple being insertable within the feed aperture;

an insert cover coupled to the handle body, the insert cover being selectively engageable with the insert cavity to cover and alternatively expose the insert cavity;

a shaver coupled to the handle body, the shaver comprising:

a neck coupled to the neck aperture, the neck being corrugated and flexible;

a head coupled to the neck, the head having a bottom face coupled to the neck and a top face, the head being comprising a set of three rounded portions in a triangular arrangement; and a set of blades coupled to the head, the set of blades comprising three rotary blades each coupled to the top face of the head, each blade being accommodated by a rounded portion of the set of rounded portions;

a motor coupled to the handle body, the motor being coupled within the inner compartment proximal the top side, the motor having a motor shaft extending through the neck to the head of the shaver, the motor shaft being in operational communication with the set of blades, the motor shaft having a rounded ball joint coupled to the head of the shaver to allow the head to pivot;

a foam dispenser coupled to the handle body, the foam dispenser having a pump coupled within the inner compartment adjacent the insert cavity and a spout coupled to the pump and extending through the front side of the handle body, the pump being in operational communication with the feed aperture to draw foam from the foam insert and release it through a distal end of the spout, the spout having a truncated conical tip coupled to the front side of the handle body;

a dispense button coupled to the handle body, the dispense button being coupled to the front side of the handle body below the tip of the spout, the dispense button being in operational communication with the pump;

a power button coupled to the handle body, the power button being coupled to the back side proximal the top side, the power button being in operational communication with the motor;

a rechargeable battery coupled to the handle body, the rechargeable battery being coupled within the inner compartment adjacent the bottom side, the rechargeable battery being in operational communication with the dispense button and the power button; and a charge port coupled to the handle body, the charge port extending through the bottom side and being in operational communication with the rechargeable battery, the charge port being configured to receive a charging cable.

* * * * *